United States Patent [19]

Maruyama et al.

[11] 4,359,074

[45] Nov. 16, 1982

[54] FUEL SUPPLYING APPARATUS

[75] Inventors: Eisuke Maruyama, Kawasaki; Hiromitsu Kobayashi, Yokohama; Masakazu Mitsuhashi, Kawasaki; Hiromichi Takeuchi, Yokohama; Yoshiki Futamura, Funabashi; Naohito Suzuki, Kawasaki, all of Japan

[73] Assignees: Tokico Ltd., Kanagawa; Tokico Yuki Ltd., Tokyo, both of Japan

[21] Appl. No.: 198,245

[22] Filed: Oct. 17, 1980

[30] Foreign Application Priority Data

Oct. 19, 1979 [JP] Japan ..... 54/135029

[51] Int. Cl.[3] ..... B65B 3/04

[52] U.S. Cl. ..... 141/94; 141/206; 141/DIG. 1; 251/65

[58] Field of Search ..... 251/65, 30; 141/206–229, 198, 290, 346–362, 392, DIG. 1; 220/86 R

[56] References Cited

U.S. PATENT DOCUMENTS

| | | | |
|---|---|---|---|
| 2,765,802 | 10/1956 | Rowell | 251/65 |
| 3,323,560 | 6/1967 | Ehlers | 251/65 |
| 3,465,771 | 9/1969 | Tishler | 251/65 |
| 4,018,419 | 4/1977 | Monpetit | 251/65 |
| 4,195,673 | 4/1980 | Johnston et al. | 251/65 |

*Primary Examiner*—Houston S. Bell, Jr.
*Attorney, Agent, or Firm*—Michael N. Meller; Anthony H. Handal

[57] ABSTRACT

A fuel supplying apparatus comprises a fuel supplying nozzle having an ejection pipe for ejecting fuel and a supplying passage for supplying the fuel to the ejection pipe, an opening and closing valve provided in the supply passage, a nozzle lever for opening the opening and closing valve, locking mechanism for locking the opening and closing valve in an open state, negative pressure generating mechanism for generating negative pressure upon supply of the fuel outside through the ejection pipe, lock releasing mechanism for releasing the lock of the locking mechanism by the introduction of the negative pressure generated by the negative pressure generating mechanism, atmosphere introducing mechanism for introducing atmosphere into the lock releasing mechanism to neutralize the negative pressure, solenoid valve for interrupting the introduction of the atmosphere by the atmosphere introducing mechanism when no current is introduced, and allowing the introduction of the atmosphere by the atmosphere introducing mechanism when introduced with current, and detection and current applying switch for detecting the insertion of the ejection pipe inside a fuel intake opening of a vehicle and the like and introduces current to the solenoid valve.

5 Claims, 7 Drawing Figures

FUEL SUPPLYING APPARATUS

BACKGROUND OF THE INVENTION

This invention relates generally to fuel supplying or dispensing apparatus, and more particularly to a fuel supplying apparatus capable of preventing an accident in which the fuel is sprayed around before the ejection pipe is inserted inside the fuel intake opening due to valve opening operation error, by the operation of the automatic valve closing mechanism.

Generally, in a known fuel supplying apparatus, the fuel supply is started by pulling the nozzle lever after the fuel supplying nozzle is inserted inside the fuel intake opening of the vehicle, and the supply of fuel is stopped by releasing the nozzle lever when the supplied fuel reaches a predetermined quantity.

Hence, in the conventional fuel supplying apparatus, organized, for example, so that the fuel supplying pump driving motor is driven automatically when the fuel supply nozzle is unhooked from the nozzle hanger provided at the side part of the main body of the fuel supplying apparatus, when the valve of the fuel supplying nozzle is opened by mistake before the ejection pipe is inserted inside the fuel intake opening of a vehicle and the like, large quantity of fuel is sprayed around within the fuel supplying station, and was disadvantageous in that the apparatus was quite dangerous when operated incorrectly.

As opposed to this, a fuel supplying apparatus has been proposed in which a solenoid valve is provided directly on the fluid supply passage inside the fuel supplying nozzle, to automatically stop the supply of fuel without the operation of the nozzle lever by closing the solenoid valve by the control signal applied from the apparatus for supplying fluid of predetermined quantity when the supply of fuel reaches a predetermined quantity.

However, this type of fuel supplying apparatus having automatic fuel supply stopping function, must all open or close the solenoid valve against the fluid pressure or the spring force and the like, and require a large current to operate the solenoid valve, thus being disadvantageous in that the electrical power consumption of the apparatus is large and uneconomical.

SUMMARY OF THE INVENTION

Accordingly, it is a general object of the present invention to provide a novel and useful fuel supplying apparatus which has solved the above described problems.

Another and more specific object of the invention is to provide a fuel supplying apparatus in which a solenoid valve is organized to conduct and open when an ejection pipe of a fuel supplying nozzle is inserted inside a fuel intake opening, by providing a type of solenoid valve which opens upon being supplied with current in an atmosphere introducing tube of an automatic valve closing mechanism comprising a diaphragm membrane which undergoes displacement by a negative pressure. By the apparatus of the present invention, even upon a situation, for example, in which the opening and closing valve is opened by mistake before the insertion of the ejection pipe inside the fuel intake opening, when fuel flows into a negative pressure generating part, irrespective of how small the fuel quantity is, the fuel is drawn out from within the negative pressure pipe by suction. Accordingly, the pressure inside a diaphragm chamber instantly becomes of negative pressure, and the opening and closing valve is closed immediately, thus positively preventing beforehand an accident in which the fuel is sprayed around outside the fuel intake opening.

Still another object of the invention is to provide a fuel supplying apparatus which positively prevents the overflowing of the fuel from the fuel intake opening due to the oversupplying of the fuel. According to the apparatus of the invention, upon supply of fuel to the full capacity of the tank, for example, the supply of fuel is stopped automatically when the pressure inside the diaphragm chamber becomes of negative pressure by the interruption of an open part of the atmosphere introducing tube by the fluid surface of the fuel.

Another object of the invention is to provide a fuel supplying apparatus having a high safety factor organized so that, in case of a power failure accident, the solenoid valve closes automatically to stop the supply of fuel.

Still another object of the invention is to provide a fuel supplying apparatus in which the solenoid valve is closed when the supplying quantity of fuel reaches a predetermined quantity by cutting off applying of current to the solenoid to put a negative pressure on the diaphragm membrane. According to the provision of the invention, the opening and closing valve can be closed automatically, and the opening and closing valve can be opened and closed and controlled by small electric current, as compared to an apparatus in which the opening and closing solenoid valve is provided directly in the passage of the fuel supplying nozzle.

Another object of the invention is to provide a fuel supplying apparatus in which a reed switch provided at the ejection pipe of the fuel supplying nozzle as an ejection pipe insertion detection switch, and this reed switch is operated by a magnet provided on a slider, when the slider provided at the ejection pipe moves to a predetermined position by the insertion operation of the ejection pipe into the fuel intake opening. According to the apparatus of the invention, the insertion of the ejection pipe inside the fuel intake opening can be detected positively and simply, and has a broad application field since the nozzle can be applied to either a suspending type or ground type fuel supplying apparatus.

Other objects and further features of the present invention will be apparent from the following detailed description with respect to preferred embodiments of the invention when read in conjunction with the accompanying drawings.

DETAILED DESCRIPTION

Figure 1:
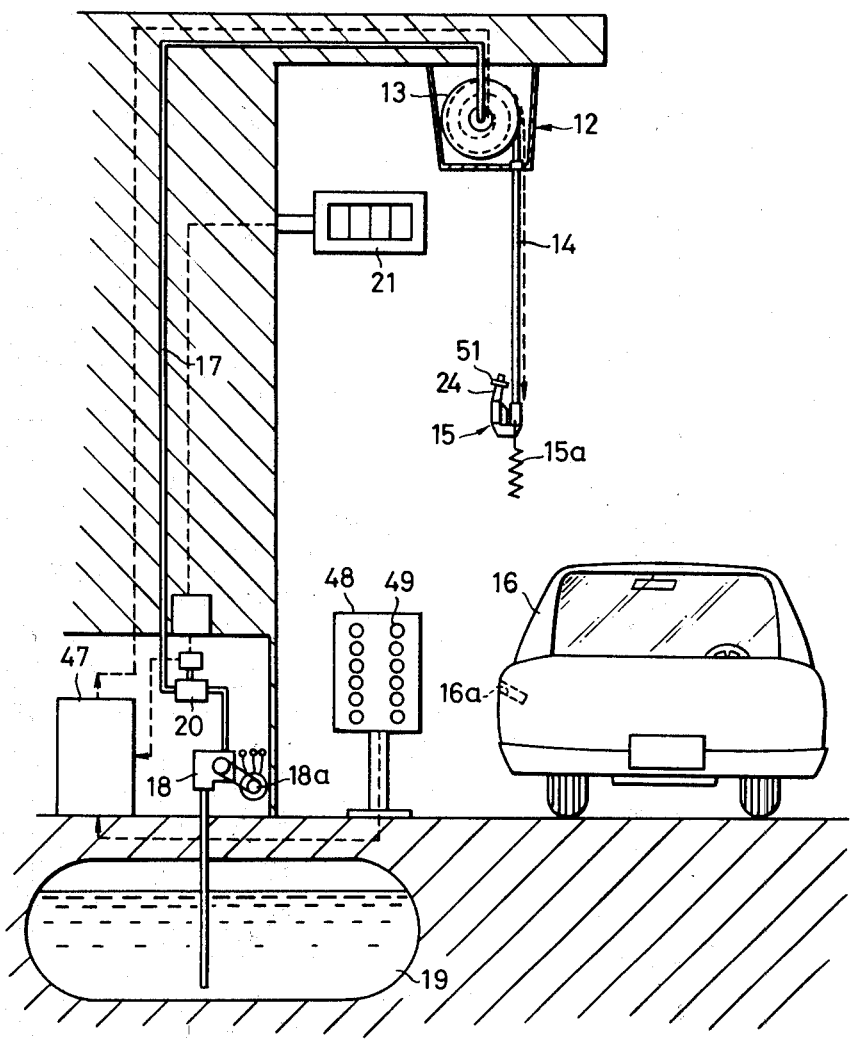
FIG. 1 is a view showing a general construction of an embodiment of a suspending type fuel supplying apparatus capable of supplying fuel fluid of predetermined quantity applied with a fuel supplying apparatus of the present invention.

In FIG. 1, a fuel supplying apparatus 11 comprises a delivery unit 12 attached to the roof of the fuel supplying station, and constructed so that a fuel supplying hose 14 is rolled around a hose reel 13 inside the delivery unit 12. A fuel supplying nozzle 15 provided at the end part of the hose 14 is inserted inside a fuel intake opening 16*a* of the vehicle to supply the fuel. The fuel supplying hose 14 inside the delivery unit 12 is connected to a fuel supplying pump 18 through a fixed pipe arrangement 17. The fuel pumped up from an underground tank 19 by the pump 18 is supplied to the delivery unit 12 through the fixed pipe arrangement 17 after passing through a flowmeter 20, and supplied to the nozzle 15 through the hose 14. The flow quantity of the fuel supplied through the nozzle 15 is measured by the flowmeter 20, and displayed by a supplied fuel quantity displaying device 21 provided at a position easily seen near the roof part of the fuel supplying station.

Figures 2, 5, 6:
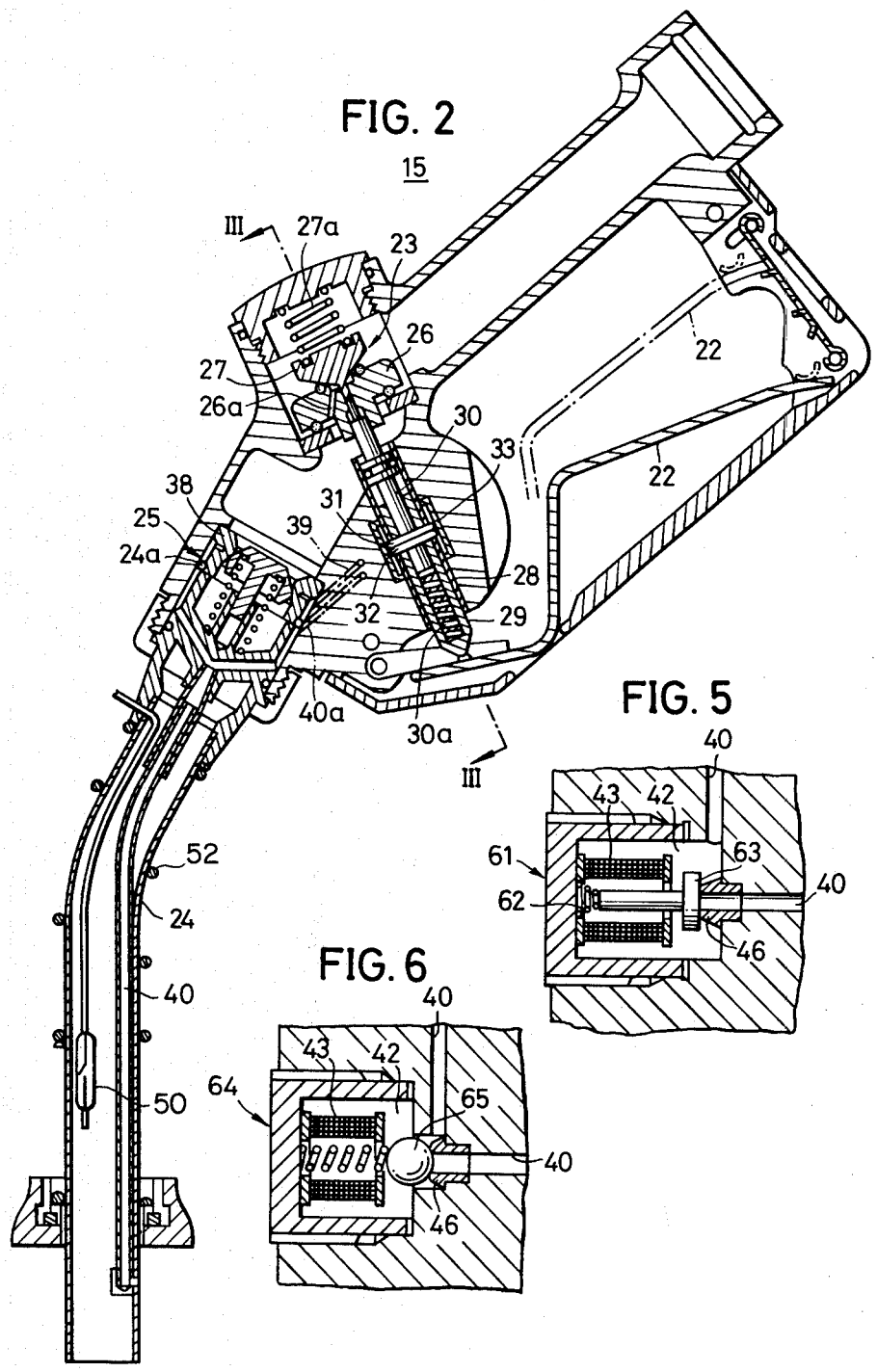
FIG. 2 is a cross-sectional view of an embodiment of a fuel supplying nozzle of the apparatus of FIG. 1.
FIG. 5 is a cross-sectional view of a modification of the solenoid valve part shown in FIG. 4.
FIG. 6 is a cross-sectional view of another modification of the solenoid valve part shown in FIG. 4.

An opening and closing valve 23 and an automatic valve 25 opened and closed by the operation of a nozzle lever 22 and closed by a control signal, are provided inside a casing of the fuel supplying nozzle 15 as shown in FIG. 2. The valve 23 comprises a pair of main and sub valve bodies 26 and 27, and both valve bodies 26 and 27 are urged in the valve closing direction by a spring 27*a*. The displacing movement of the nozzle lever 22 is transmitted to the valve bodies 26 and 27, by a shaft 29 and a valve shaft 30 at a bottom comprising intermediate space, inserted freely slidable inside a sleeve 28. The valve shaft 30 has its bottom part inserted freely slidable inside the shaft 29, and a compressed spring 30*a* is provided under pressure between the bottom edge part of the valve shaft 30 and the bottom part of the shaft 29. In a state shown in FIGS. 2 and 3, two rollers 31 and 32 used as locking parts, are engaged to the valve shaft 30, and thus the valve shaft 30 and the shaft 29 undergo displacement unitarily.

Figure 3:
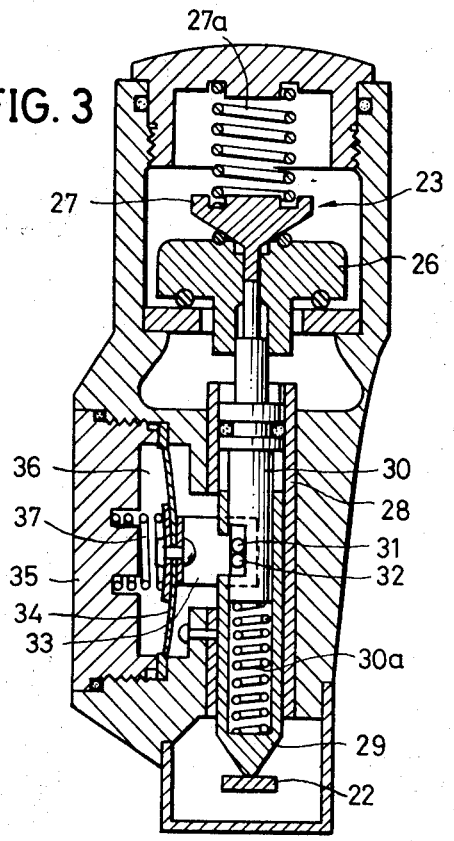
FIG. 3 is a cross-sectional view of the fuel supplying nozzle of FIG. 2 taken along the lines III—III.

The rollers 31 and 32 are respectively supported of their ends by a receiving plate 33, and is freely movable in the moving direction of the shaft 29. The receiving plate 33 is fixed to a diaphragm membrane 34 as shown in FIG. 3, and diaphragm chamber 36 is partitioned by the diaphragm membrane 34 and a lid 35 provided outside the diaphragm membrane 34. A compressed spring 37 is provided under pressure inside the diaphragm chamber 36, and thus the rollers 31 and 32 are urged in an engaging direction with the valve shaft 30. When the engagement of the valve shaft 30 with the rollers 31 and 32 is disengaged, the valve shaft 30 becomes movable, separately with respect to the shaft 29. Regarding an example of the lock mechanism of the valve shaft 30, it is described in detail in the U.S. Pat. No. 3,638,689, for example.

One end of a negative pressure pipe 38 is opened at the internal periphery of a valve seat 38 of the automatic valve 25, and the valve seat itself becomes a Venturi tube part upon opening of the automatic valve 25, thus the air inside the negative pressure pipe 39 is drawn out under suction into the valve seat 38. The other end of the negative pressure pipe 39 is opened inside the diaphragm chamber 36. Furthermore, an atmosphere introducing tube 40 is provided inside an ejection pipe 24 of the fuel supplying nozzle 15, and one end of the atmosphere introducing tube 40 is opened as an atmosphere introducing opening at the front edge sidewall part of the ejection pipe 24. On the other hand, the other end of the atmosphere introducing tube 40 is connected to the diaphragm chamber 36 through a solenoid valve 41 provided between tubes 40*a* inside the fuel supplying nozzle 15.

Figure 4:
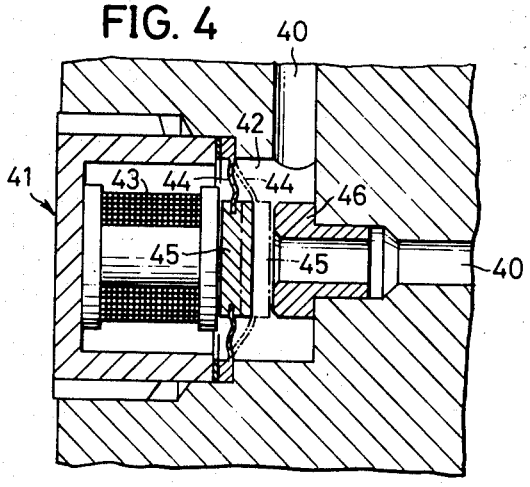
FIG. 4 is an enlarged cross-sectional view of an embodiment of a solenoid valve part of the fuel supplying nozzle of FIG. 2.

As shown in FIG. 4, the solenoid valve 41 is screwed fixedly inside a space 42 formed half way between the atmosphere introducing tube 40. A solenoid 43 is partitioned from the space 42 by a diaphragm membrane 44, and a valve body 45 comprising a magnetic body fixed at the center part of the diaphragm membrane 44 separates from or makes contact with a valve seat 46, according to the magnetization or demagnetization state of the solenoid 43. The solenoid 43 is not conducting upon non-supplying of the fuel, and the valve body 45 makes contact with the valve seat 46 due to the elasticity of the diaphragm membrane 44 and the magnetic repellent force exerted by the solenoid 43. The solenoid valve 41 is then closed.

When the solenoid 43 is conducting and magnetized upon supplying of fuel, the valve body 45 is separated from the valve seat 46 by the magnetic attraction force of the solenoid 43 exerted against the elasticity of the diaphragm membrane 44.

In this embodiment of the present invention, the solenoid valve 41 is provided inside the atmosphere introducing tube 40, and an O-ring 24*a* is provided at the connection part between the ejection pipe 24 and the fuel supplying nozzle 15, thus preventing the short connection between the negative pressure tube 39 and the atmosphere introducing tube 40 by this O-ring 24*a*. In addition, when it is possible to provide the solenoid valve 41 in the up-stream side of the above O-ring 24*a*, this O-ring can be eliminated.

The opening and closing control of the solenoid valve 41 is, in this embodiment, performed by the signal emitted from a control part 47 for controlling the supply of fluid of predetermined quantity provided inside the fuel supplying station structure. This control part 47 is determined of its expected fuel supply quantity by a preset device 48 for presetting the predetermined quantity of fluid to be supplied, and generates a control signal when the supplied fuel quantity coincides with the predetermined fuel supply quantity. The preset device 48 is positioned outside near the fuel supply servicing area, and comprises a plurality of push buttons showing the corresponding fuel supply quantity on the front pannel.

An insertion detection switch 50 detects the insertion of the ejection pipe 24. In this embodiment of the invention, a reed switch is used as the insertion detection switch 50. The switch 50 is fixed on the inner wall near the front end part of the ejection pipe 24. An adapter 51 used as a slider which fixedly engages with the open part of the fuel supplying opening 26*a* upon supply of fuel, is inserted freely slidable on the outer wall near the front end part of the ejection pipe 24. By the compressed spring inserted between the joint base part of the ejection pipe 24 and the adapter 51, the adapter 51 is constantly urged in the front end side direction of the ejection pipe 24.

A magnet 53 is provided inside the adapter 51. The adapter 51 confronts the insertion detection switch 50 when the ejection pipe 24 is inserted inside the fuel supplying opening 16*a* for a length required for the supply of fuel. Then, the switch 50 is closed by the magnetic force produced by the magnet 53 provided inside the adapter 51. The switch 50 is connected to the control part 47, and the circuit is organized so that the solenoid valve 41 conducts and opens when the switch 50 closes. Upon non-supplying of fuel, the solenoid valve 41 is closed, and the fuel supplying apparatus is in a state possible for fuel supply only when the solenoid valve 41 is open, as will be described hereinafter.

First, the operation for supplying fuel to fill the tank full without the use of the preset device 48, will now be described.

Upon non-supplying of fuel, the fuel supplying nozzle 15 is positioned at the fuel supply waiting position so as not to be in the way of a vehicle 16, and by pulling on a suspended string 15*a* suspended from the fuel supplying nozzle 15, the fuel supplying nozzle 15 can be lowered to the fuel supplying position by rotating the hose reel 13. Upon pulling of the suspended string 15*a*, a fuel supplying pump driving motor 18*a* is started, and the fuel supplying pump 18 is driven.

The ejection pipe 24 of the fuel supplying nozzle 15 is inserted into the fuel supplying opening 16*a* of the vehicle 16. This insertion of the ejection pipe 34 is detected by the switch 50, and the solenoid valve 41 is opened by the closing signal of the switch 50.

If the ejection pipe 24 is not inserted inside the fuel intake opening 16*a* to a predetermined position, the fuel supplying apparatus does not go into a state possible for fuel supply since the solenoid valve 41 does not open. Therefore, as will be described later on, even when the nozzle lever 22 is pulled by mistake before the ejection pipe 24 is inserted inside the fuel intake opening 16*a*, fuel is not sprayed around outside from the fuel supplying nozzle 15.

When the ejection pipe 24 is inserted into the fuel intake opening 16*a*, the nozzle lever 22 is pulled up to the valve opening position shown by the dotted lines of FIG. 2, and held in that locked position. Upon pulling up of the nozzle lever 22, the shaft 29 pushes the valve shaft 30 in the upward direction, and thus the sub valve body 27 separates from the main valve body 26 in the upward direction. Hence, a flow passage 26*a* formed at the main valve body 26 opens, and the fuel flows out onto the automatic valve 25 side through the flow passage 26*a*. When the nozzle lever 22 is pulled up even further, the valve shaft 30 pushes the main valve body 26 in the upward direction, and thus the valve 23 is fully opened. Since the front and rear of the main valve body 26 are respectively communicated by a flow passage 26*a* before the main valve body 26 opens, the main valve body 26 can be opened by a small force.

The fuel which has passed through the valve 23 passes through the automatic valve 25, and is supplied inside the fuel supplying opening 16*a* from the ejection pipe 24.

By the Venturi effect introduced upon the passing of the fuel through the automatic valve 25, the air inside the negative pressure pipe 39 is drawn out by suction into the automatic valve 25.

Therefore, at the early stage of the starting of the fuel supply, one end of the atmosphere introducing tube 40 is open to the atmosphere not being interrupted by the fluid surface, and the amount of air drawn out from within the diaphragm chamber 36 by the negative pressure pipe 39 is replenished by the atmosphere introducing tube 40. For this reason, it never becomes of negative pressure inside the diaphragm chamber 36, and the disphragm membrane 34 does not undergo displacement. Accordingly, the rollers 31 and 32 are engaged to the valve shaft 30, fixing the valve shaft 30 in a immovable state with respect to the shaft 29, and hence the valve shaft 30 is locked in an open position.

When the fuel supply tank (not shown) of the vehicle 16 becomes full as the supplying of fuel progresses, the open part of the atmosphere introducing tube 40 of the ejection pipe 24 is interrupted by the fluid surface inside the fuel intake opening 16*a*. On the other hand, the air is continuously drawn out by suction by the negative pressure pipe 39, and thus it instantly becomes of negative pressure inside the diaphragm chamber 36, and hence the diaphragm membrane 34 undergoes displacement to the left-hand side direction in FIG. 3 against the compressed spring 37. As a result, the rollers 31 and 32 separate from the valve shaft 30 together with the displacement of the receiving plate 33, and hence the valve shaft 30 is moved downwards against the compressed spring 30*a* by the fluid pressure and the resilient restitution of the spring 27*a* exerted on the main valve body 26 and the sub valve body 27. Accordingly, the valve 23 close, and the supply of fluid is stopped automatically.

The operator then pulls the fuel supplying nozzle 15 from within the fuel intake opening 16*a*, and releases the nozzle lever 22 from its locked position to the valve closing position. Hence, the shaft 29 is pushed downwards by the compressed spring 30*a*, and the rollers 31 and 32 engages again with the valve shaft 30.

Upon supplying fuel to fill the tank full, the supplying of fuel is automatically stopped by the operation of the automatic valve closing mechanism when the atmosphere introducing opening of the atmosphere introducing tube 40 is interrupted by the fuel.

Next, the operation upon establishing of the fuel supply of predetermined quantity by the use of the preset device 48 will now be described.

First, before performing the fuel supplying operation, a push button key 49 of the preset device 48 which shows the desired fuel supplying quantity is pushed, to establish the desired fuel supplying quantity in the control part 47. This fuel supplying quantity is transmitted to the control part 47 and memorized therein. When the establishing of the fuel supplying quantity by the preset device 48 is completed, the fuel supplying nozzle 15 is inserted inside the fuel intake opening 16*a* of the vehicle 16.

When the nozzle lever 22 is pulled by mistake before the ejection pipe 24 is inserted inside the fuel intake opening 16*a*, the fuel supplied within the fuel supplying nozzle 15 flows in the direction of the automatic valve 25 through the valve 23. However, the solenoid valve 41 is not open, and thus the negative pressure pipe 39 and the atmosphere introducing tube 40 are not communicated. Accordingly, when the fuel flows through within the automatic valve 25, irrespective of how small the fluid quantity is, air is drawn out from the negative pressure tube 39 by suction, and the pressure inside the diaphragm chamber 36 immediately becomes of negative pressure. That is to say, the state inside the diaphragm chamber 36 becomes a state identical to that described earlier, in which the open part of the atmosphere introducing tube 40 is interrupted upon supply of fuel to the full capacity of the tank, and the valve 23 is closed immediately by the displacement of the diaphragm membrane 34 due to the negative pressure.

Hence, even when the nozzle lever 22 is pulled by mistake before the ejection pipe 24 is inserted inside the fuel supplying opening, the valve 23 once opened immediately closes, and there is no inconvenience like the spraying around of the fuel from the fuel supplying nozzle 15.

When the ejection pipe 24 is inserted inside the fuel intake opening 16*a* to a predetermined position, the solenoid valve 41 opens, and thus upon pulling of the nozzle lever 22 after the pulling of the nozzle lever by mistake, normal fuel supplying operation is started.

When the supply of fuel reaches a predetermined fuel supplying quantity as the fuel supplying progresses, the solenoid valve 41 is cut off its conduction by the signal from the control part 47, and hence the solenoid valve 41 closes. Resultingly, the negative pressure pipe 39 communicated with the atmosphere by the atmosphere introducing tube 40 until that point, becomes cut off its communication with the atmosphere, and the pressure inside the diaphragm chamber 36 becomes of negative pressure. Accordingly, as described above, the valve 23 is closed automatically along with the displacement of the diaphragm membrane 34.

As described above, when the fuel quantity to be supplied is specified, the solenoid valve 41 closes simultaneously as when the supply of fuel reaches a predetermined fuel supply quantity. Accordingly, the supply of fuel is automatically stopped as the diaphragm membrane 34 is displaced by the suction due to the negative pressure. This displacement of the diaphragm membrane 34 is a mechanical displacement in which the negative pressure is used, and thus a large current is not required to open and close the solenoid valve 41, resulting in a very small electrical power consumption of the solenoid valve 41.

Moreover, even in a situation in which the control part 47 becomes inoperable due to a power failure accident, the solenoid valve 41 is cut off its conduction simultaneously as the power failure occurrence, automatically closing the solenoid valve 41, and hence inconveniences such as the continuation of the supplying of fuel in a non-controlled state is not introduced.

In the above embodiment of the invention, besides the construction of the solenoid valve shown in FIG. 4, for example, the valve seat 46 can be formed from a magnetic material, and by fixing a magnet onto the valve body 45, the valve body 45 can constantly be positioned on the valve seat 46 by the magnetic force of the magnet, and organized so that upon starting of the supply of fuel, the valve body 45 is separated from the valve seat 46 by a magnetic force greater than the magnetic force generated when the solenoid 43 conducts. The solenoid valve can also be constructed as a solenoid valve 61 shown in FIG. 5, in which a spring 62 urges a valve body 63. In addition, the solenoid valve can use a spherical shape valve body 65 shown in a solenoid valve 64 of FIG. 6 instead of the flat plate valve body.

Figure 7:
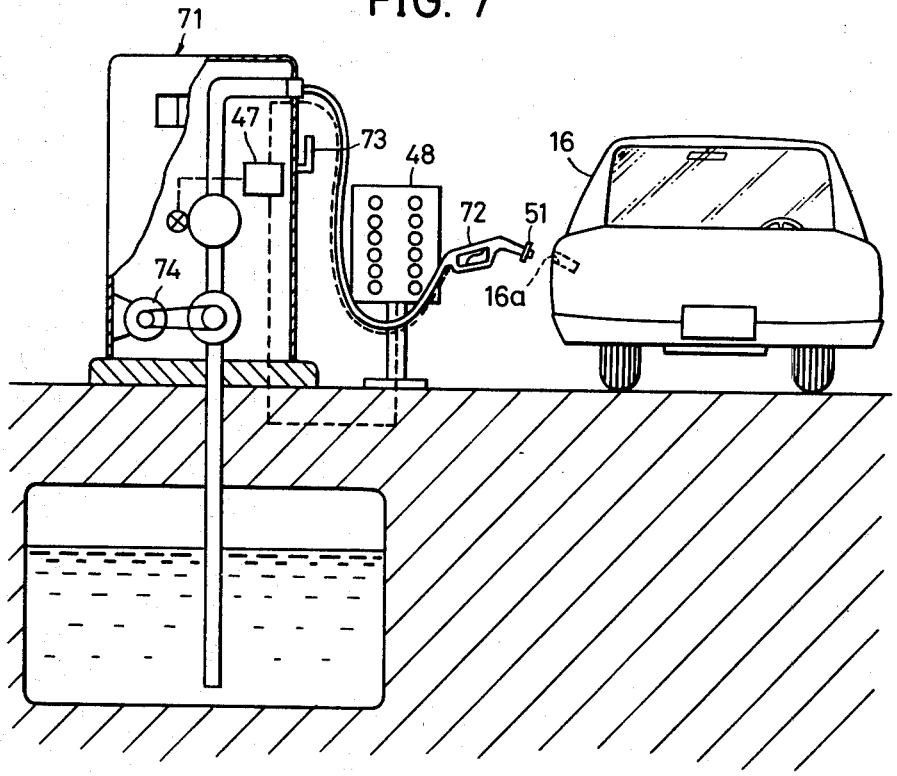
FIG. 7 is a view showing a general construction of an embodiment of a round type fuel supplying apparatus applied with a fuel supplying apparatus of the present invention.

Furthermore, in the above embodiment of the invention, the suspending type fuel supplying apparatus was used as an example of the fuel supplying apparatus, but the invention can also be applied to a ground type fuel supplying apparatus 71 shown in FIG. 7. In this embodiment of the invention, when a fuel supplying nozzle 72 is unhooked from a nozzle hanger 73 provided at the side of the fuel supplying apparatus 71, the apparatus is set in an operational state by starting of a fuel supplying pump driving motor 74.

Furthermore, in each of the above embodiments, the insertion detection switch is not limited to a reed switch provided at the ejection pipe 24, and can be, for example, a piezo-electric switch, a capacitive switch, or a photoelectric switch provided at the adapter 51. Moreover, the attaching position of these switches is not limited at the ejection pipe 24 or the adapter 51, and other attaching positions can be selected.

In each of the above embodiments, the automatic valve closing mechanism is constructed so that by respectively displacing the valve shaft 30 with respect to the shaft 29, the nozzle lever 22 closes the valve 23 although the nozzle lever 22 is in a valve opening position. However, for example, a fuel supplying nozzle which is capable of moving the fulcrum of the nozzle lever 22 can be used, and an automatic valve closing mechanism provided at the fulcrum part of the nozzle lever 22, to move the fulcrum of the nozzle lever 22 to the position which closes the valve 23 by the operation of the automatic valve closing mechanism, holding the rear end part of the nozzle lever 22 at the valve opening position.

Further, this invention is not limited to these embodiments. Variations and modifications may be made without departing from the scope of the invention.

What is claimed is:

1. A fuel supplying apparatus comprising:

a fuel supplying nozzle having an ejection pipe for ejecting fuel and a passage for supplying fuel to said ejection pipe;

an opening and closing valve means provided in said supply passage;

a nozzle lever for opening said opening and closing valve;

locking means for locking said opening and closing valve in an open state;

negative pressure generating means for generating negative pressure upon supply of said fuel outside through said ejection pipe;

lock releasing means for releasing the lock of said locking means by the introduction of said negative pressure generated by said negative pressure generating means;

atmosphere introduction means for introducing atmosphere into said lock releasing means to neutralize said negative pressure;

solenoid valve means for interrupting or allowing the introduction of the atmosphere by said atmosphere introducing means; and detection means for enabling the detection of the insertion of said ejection pipe inside a fuel intake opening of a vehicle and allowing the atmosphere introduction by said solenoid valve means, and for interrupting the atmosphere introduction by said solenoid valve means when said ejection pipe is not inserted inside said fuel intake opening, said opening and closing valve means, locking means, negative pressure generating means, locking releasing means, atmosphere introducing means and solenoid valve means accommodated within said fuel supplying nozzle, said detection means consisting of a magnet provided freely displaceable at said ejection pipe, and a reed switch opening or closing according to the displacement of said magnet, said magnet undergoing displacement upon insertion of said ejection pipe inside said fuel intake opening to open or close said reed switch by the magnetic force emitted by said displaced magnet so that said solenoid valve interrupts the atmosphere introduction, and said lock releasing means releasing the lock of said locking means by use of said negative pressure upon interruption of said atmosphere introduction to close said opening and closing valve.

2. An apparatus as described in claim 1 in which said solenoid valve means interrupts the atmosphere introduction by said atmosphere introducing means when no current is applied and allows the atmosphere introduction by said atmosphere introducing means when applied with current, and said detection means applies current to said solenoid valve means upon insertion of said ejection pipe inside said fuel intake opening of said vehicle and applies no current upon non-insertion of said ejection pipe inside said fuel intake opening of said vehicle.

3. An apparatus as described in claim 1 in which said magnet is provided freely displaceable at the outer periphery of said ejection pipe, said magnet being a pipe-shaped body having an outer diameter larger than the diameter of said fuel intake opening, and said magnet engaging to the outer periphery surface of said fuel intake opening upon insertion of said ejection pipe inside said fuel intake opening to relatively undergo displacement with respect to said ejection pipe.

4. An apparatus as described in claim 1 in which said locking means comprises a valve shaft which unitarily undergoes displacement with said opening and closing valve, and a locking part which locks said opening and closing valve in an open position, and said lock releasing means comprises a diaphragm chamber which is communicated to said negative pressure generating means and said atmosphere introducing means and introduced respectively by said negative pressure and atmosphere, a diaphragm membrane which patitions said diaphragm chamber, and a displacing part which unitarily displaces said locking part with said diaphragm membrane, said diaphragm membrane and said displacing part undergoing displacement to release the lock against said valve shaft by said locking means when the pressure inside said diaphragm chamber becomes of negative pressure.

5. An apparatus as described in claim 1 in which said solenoid valve means comprises a valve body which opens and closes said atmosphere introducing passage, an urging means for constantly urging said valve body to close the passage of said atmosphere introducing passage, and a solenoid which is applied with current and displaces said valve body against said urging means to open the passage of said atmosphere introducing passage by said detection means, the solenoid being cut off its applying of current upon stoppage of the supply of fuel, said valve body displaced by said urging means due to the cut off applying of the current to said solenoid to close the passage of said atmosphere introducing passage.

* * * * *